United States Patent [19]

Bennett

[11] Patent Number: 4,702,058

[45] Date of Patent: Oct. 27, 1987

[54] THERMAL STRUCTURAL WALL PANEL

[76] Inventor: Douglas E. Bennett, 1027 Mansfield Ct., Norcross, Ga. 30093

[21] Appl. No.: 931,561

[22] Filed: Nov. 17, 1986

[51] Int. Cl.[4] ..... E04C 1/00

[52] U.S. Cl. ..... 52/584; 52/309.11; 52/601

[58] Field of Search ..... 52/309.9, 309.11, 309.12, 52/309.17, 601, 583, 584

[56] References Cited

U.S. PATENT DOCUMENTS

| | | | |
|---|---|---|---|
| 1,983,020 | 12/1934 | De Vol | 52/584 |
| 2,664,740 | 1/1954 | Cochrane | 52/601 |
| 2,703,003 | 3/1955 | Rappel | 52/601 |
| 3,546,841 | 12/1970 | Smith | 52/309.11 |
| 3,688,458 | 9/1972 | Inmon | 52/309.11 |
| 3,736,715 | 6/1973 | Krumweide | 52/601 |
| 4,074,141 | 2/1978 | Bryant | 52/584 |
| 4,078,348 | 3/1978 | Rothman | 52/309.11 |
| 4,185,437 | 1/1980 | Robinson | 52/601 |
| 4,597,813 | 7/1986 | Hipkins | 52/309.11 |

FOREIGN PATENT DOCUMENTS

| | | | |
|---|---|---|---|
| 544862 | 2/1956 | Belgium | 52/583 |

*Primary Examiner*—Henry E. Raduazo
*Attorney, Agent, or Firm*—Earl D. Harris

[57] ABSTRACT

Prefabricated architectural or decorative wall system having thin slabs of decorative materials, such as marble, granite, other natural stone or aggregates thereof, or other decorative exterior finish material, as an exterior finish bonded to the exterior of a thermally insulated structural panel. Such wall panels, including door and window openings are prefabricated at a plant location and assembled at the building site by use of internal fastening means. Each section or panel is itself a structural member and the system requires no frame or "superstructure" for support.

The decorative exterior slabs are placed in rows or designs as aesthetics may dictate with adjoining edges spaced apart and those spaces filled with chemically modified concrete, grout or caulking to match material to be placed between adjoining panels on assembly.

5 Claims, 10 Drawing Figures

THERMAL STRUCTURAL WALL PANEL

BACKGROUND OF THE INVENTION

This invention relates generally to the building or construction industry and more particularly to prefabricated architectural or decorative wall panels that have structural integrity and high insulation characteristics.

Prefabrication of panels for various types of walls is, of course, well known, and the application has been made to practically all types of construction. Such prefabrication is done for a variety of reasons, including (without limitation) cost savings, engineering integrity, uniformity, ease of assembly, quality control, and others.

In most commercial construction, however, such walls or panels for walls have been of the curtain-type, lacking structural integrity and, many times, insulation quality in and of themselves. They usually require mounting onto some type of frame or superstructure, and attachment or insertion of additional insulation. The erection of such panels entails first the construction of a frame and then the mounting or attaching of the wall panels to the frame.

Additional steps are also necessary when architectural or decorative surfaces are desired such as marble, granite, aggregates or natural stone, and the like. Such finish surfaces have to be mounted or attached to the exterior surface of the wall panel after it is itself in place. Such attachment is specialized, costly and many times inadequate. Problems are also associated with the transportation and handling of such decorative surfaces without damage or destruction.

Although time savings and cost minimization has been improved by the use of wall panels in construction adaptable to the same, time and cost savings have not been experienced in the framing, insulation and separate installation of decorative surfaces required in their use.

SUMMARY OF THE INVENTION

The present invention, however, provides wall panels with preattached decorative finishes combined with load carrying capacity and insulation qualities superior to walls constructed in the conventional manner. The invention incorporates many desirable features resulting in a low cost, strong load carrying ability, thermal insulated, light weight, easily erected, durable, dimensionally stable panel that is intended primarily for use as exterior in commercial structures where highly decorative finish facade, such as marble, granite or aggregate stone, are desired.

The basic structure of the invention utilizes a core of ridged insulation material (such as expanded polystrene polyisocyanurate) with a sheeting of exterior grade surface material laminated to each side and parallel metal channels attached to the vertical edges. Smaller channels are attached to either vertical channel to form flanges to attach one panel to another., Decorative facing facade is bonded to the surface material by use of polymer concrete (or other equivalent bonding agent).

The facade thus used is reinforced by the entire structure of the panel form the time of manufacturing the panel; therefore, thinner veneers of such materials as marble, granite, stone aggregate and the like can be utilized in such panels. This greatly reduces both the weight of the panel and the likelihood of damage by breakage during transportation and erection.Thus, a primary object of the invention is to provide an improved wall panel that can be easily constructed in plant or central location utilizing construction line techniques and shipped to a building site for assembly.

It is a further object of the invention to provide an improved wall panel that has structural integrity itself and does not depend on a frame in its assembly in the final structure.

It is further an object of the invention to provide an improved wall panel which has integrated therein varying thermal properties as dictated by need determined prior to construction.

It is further an object of the invention to provide an improved wall panel that has integrated therein architectural or decorative surfaces.

It is further an object of the invention to use of extremely thin architectural or decorative surfaces without loss or breakage during transport.

It is further an object of the invention to provide a lightweight structural wall panel that can be easily transported and maneuvered for assembly.

DESCRIPTION OF THE PREFERRED EMBODIMENT

While it must be understood that the wall panels of the invention may take an infinte number of shapes, sizes and dimensions depending on the architectural needs of the structure which they will compose, the drawings here illustrate a rectangular shaped panel, of any desired dimensions, which when attached to other similar panels form a wall for a commercial building or other structure.

Figure 1:
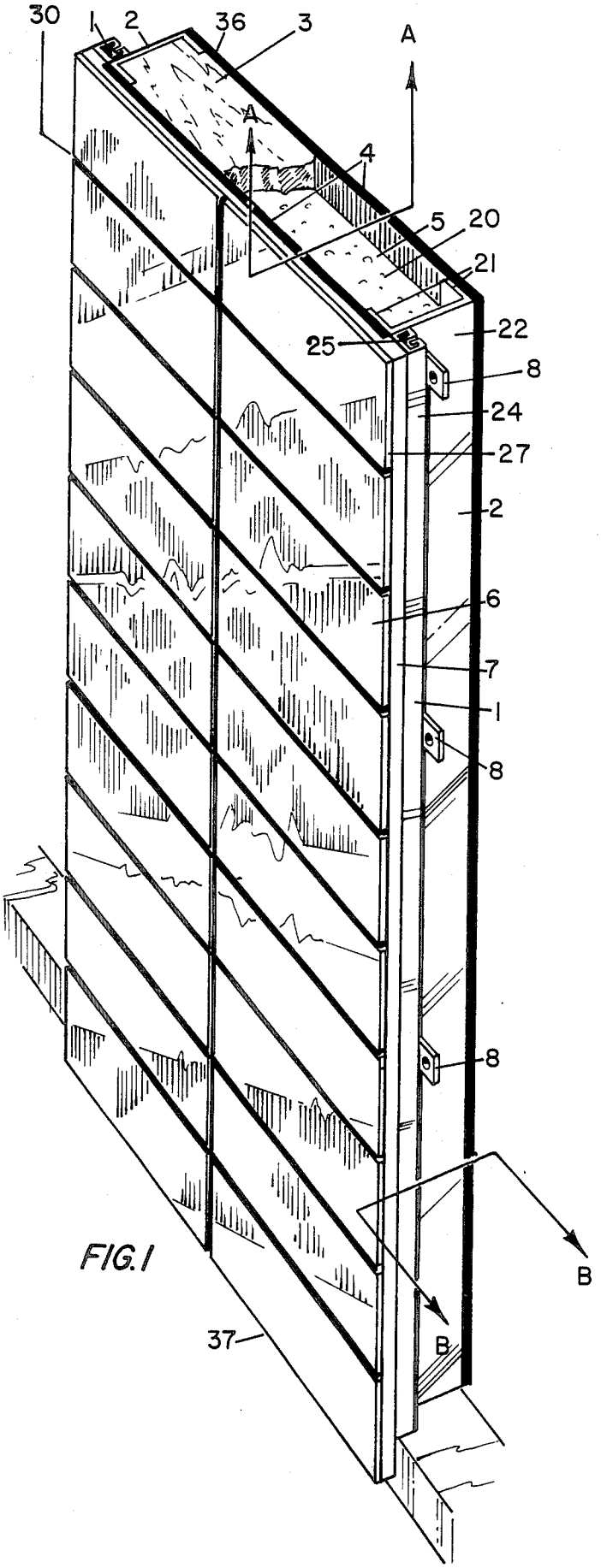
FIG. 1 is a perspective view of a respective panel section with portions broken away.
Figure 2:
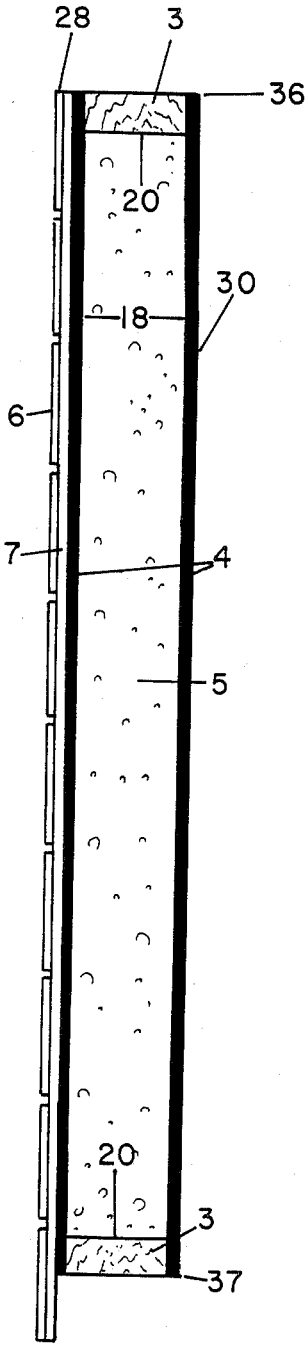
FIG. 2 is a cross-sectional view of the panel section in FIG. 1 taken substantially along the line A—A.
Figure 3:
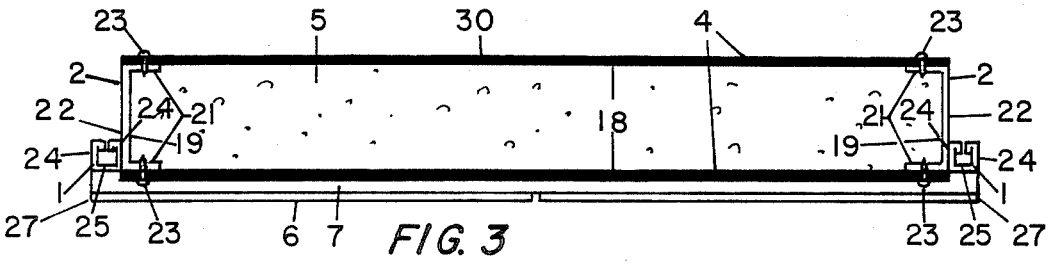
FIG. 3 is a cross-sectional view of the panel section in FIG. 1 taken substantially along the line B—B.

A perspective view of the panel 30 is shown in FIG. 1 and cross sectional views in FIG. 2 and FIG. 3 wherein the core 5 is a light weight ridged heat insulation, such as expanded polystrene, generally rectangular in shape and having opposed major surfaces 18, opposed longitudinal edges 19 and opposed ends 20. The depth or thickness as may be such as to obtain the desired insulation factor.

Heavy gauge metal, or equivalent structural strength, squared U-shaped channels 2 are placed along both longitudinal edges 19 of the core 5. The legs 21 of the U-shaped channel engage the major surfaces 18 of the core 5 adjacent to the longitudinal edges 19.

Sheeting 4 of an exterior grade plywood, wafer board, Structurwood® or other similar material is attached by metal screws 23 to the legs 21 of the U-shaped channels 2 and engaging the entire major surfaces 18 of both sides of the core 5.

End caps 3 of steel or wood are placed on the opposed ends 20 of the core 5 between the legs 21 of the U-shaped channels 2 and also between the sheeting 4. Said end caps 3 are secured by metal screws 23. It is noted that both the U-shaped channel 22 and the sheeting 4 do not extend beyond the end cap 3 at the upper end 36 but may so do at the bottom end 37 of the panel 30.

One leg 24 of a squared C-shaped channel 1 is welded or otherwise permanently attached to the closed end or bight 22 of the U-shaped channel 2 whereby the closed end or bight 25 of the C-shaped channel 1 and one of the legs 21 of the U-shaped channel 2 substantially form a single plane. It is noted that the C-shaped channel 1 further has flanges 26 facing inward opposite its bight 25.

A veneer facade 6 is bonded to the sheeting 4, the leg 21 of the U-shaped channel 2, and the bight 25 of the C-shaped channel 1 with polymer concrete 7 or other similar bonding material. The overall combination of such veneer facades 6 are of sufficient size whereby its longitudinal edges 27 are flush with the exposed legs 24 of the C-shaped channels 1 and its upper end 28 are flush with the end cap 3 at the upper end.

Figure 4:
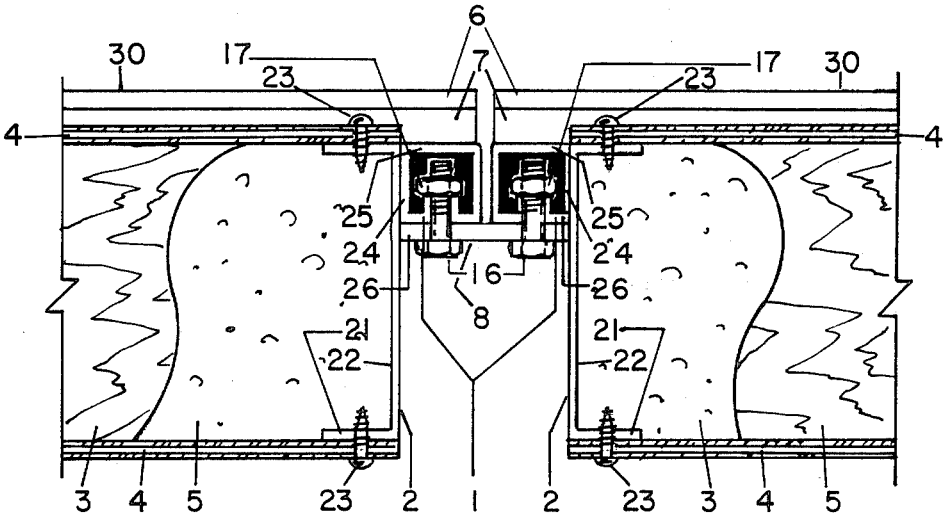
FIG. 4 is a detail showing a vertical view of the sides of two panel sections joined together with an appropriate fastening means.
Figure 6:
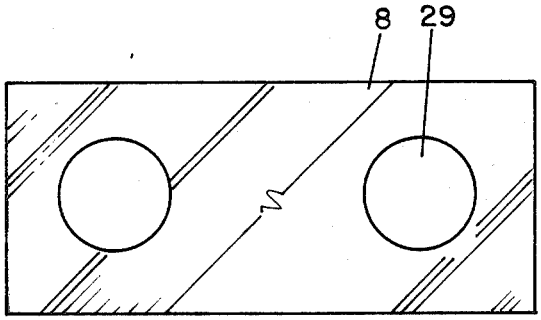
FIG. 6 is a cross-sectional view of a panel section similar to FIG. 1 taken substantially along the line A—A where the said section has been set on the base or floor and a roof truss has been set on the top.
Figure 5:
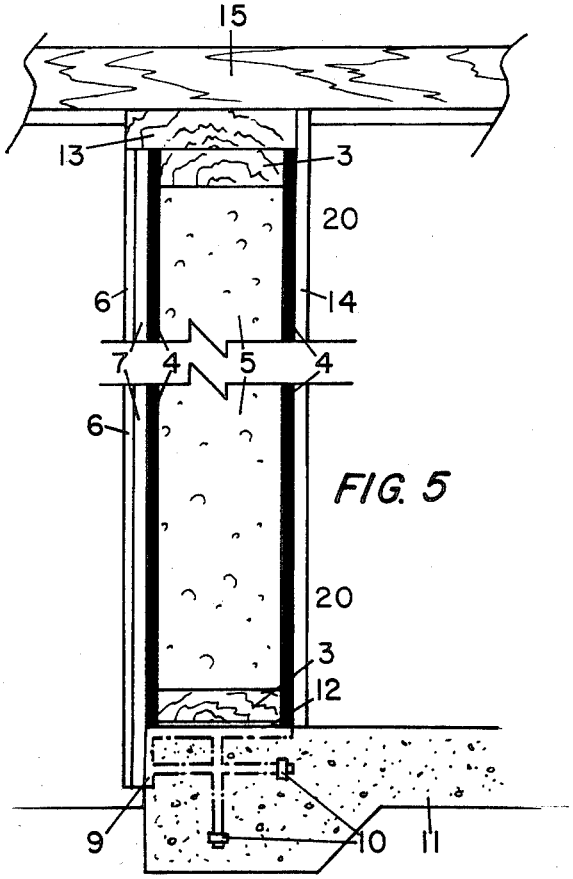
FIG. 5 is a detail of the attaching plate.

A method of attaching two panels 30 is illustrated in FIG. 4 whereby the corresponding C-shaped channels 1 of two panels 30 are placed parallel to one another and are held at a predetermined distance from one another by a fastening plate 8 (shown in detail in FIG. 6. A bolt 16 is inserted through one of the holes 29 in the fastening plates 8 and between the flanges 26 of the C-shaped channels. A nut 17 is placed inside the said channel 1. Said flanges 26 are a sufficient distance apart to permit the bolt 16 to freely move between them but prevent the nut 17 from coming out. As the bolt 16 is tightened into the nut 17, the fastening plate 8 is firmly engaged against the said C-shaped channels 1, thus affixing the C-shaped channels 1 of both panels 30 rigedly together.

FIG. 6 illustrates an erected panel 30 where the lower end cap 3 rests on a still seal 12. The panel 30 is fixably attached to a base plate 9 by welding the U-shaped channel 2 to said base plate 9. Naturally, the base plate 9 itself is attached to the concrete floor 11 by embedded anchors 10. A top plate 13 is fixably attached to both the roofing truss 15 and the top and cap 3 of the panel 30. It is noted that the interior wall 14 is directly attached to the interior sheeting 4. Such erection method as illustrated is not intended to be exclusive but merely illustrative.

Figure 7:
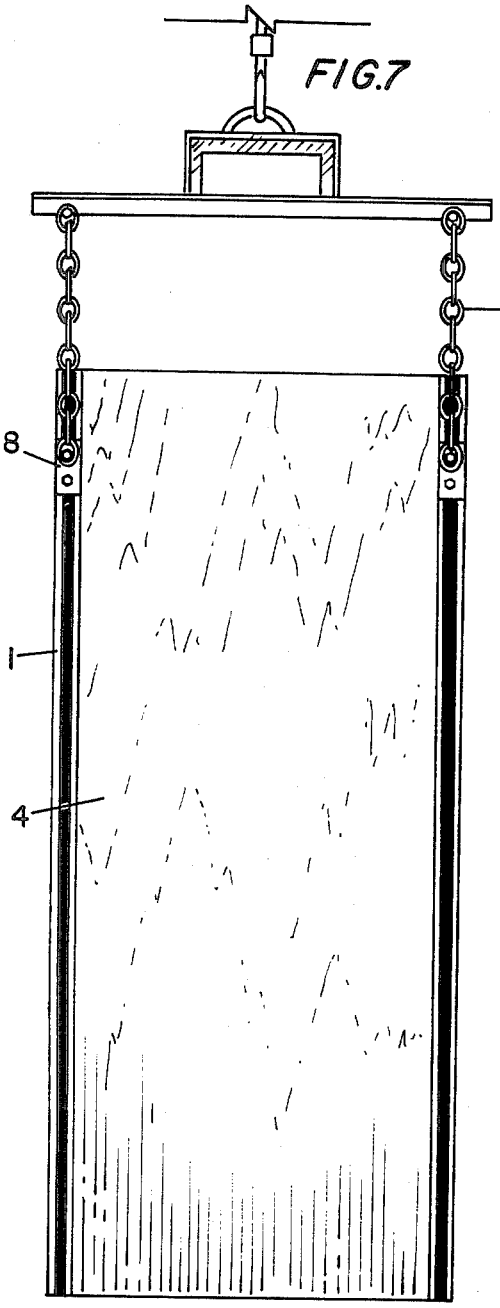
FIG. 7 is a frontal view of a panel with moving or transportational device attached.
Figure 8:
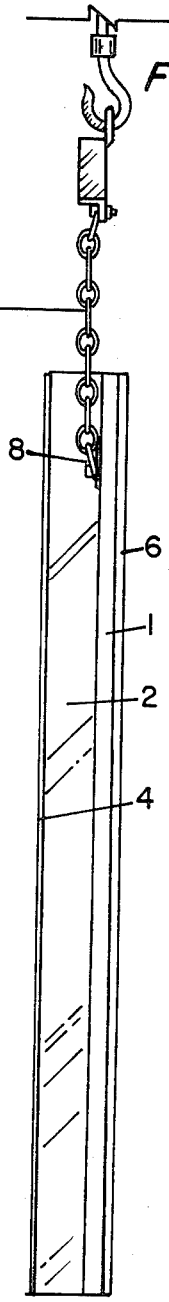
FIG. 8 is a side view of FIG. 6.

FIG. 7 and FIG. 8 show a method of moving such panels by the use of an angle iron harness 38 and illustrate the ease and safety with which a panel can be moved by attaching the harness to the fastening plates 8, which are themselves attached to the C-shaped channel 1 in a similar manner as the method described above for attachment of two panels 30 to one another.

Figure 9:
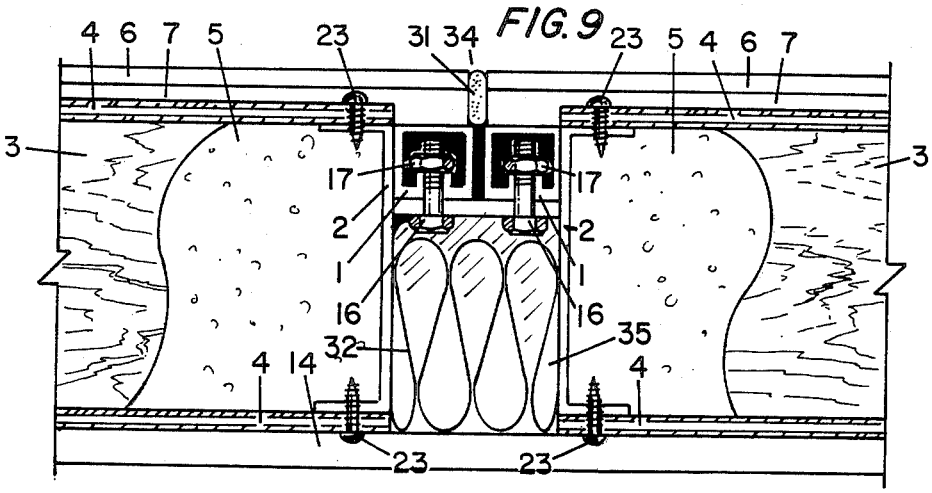
FIG. 9 is an end view of the joint between two panels showing a finishing method of the space between the surfaces and the interior wall attached.
Figure 10:
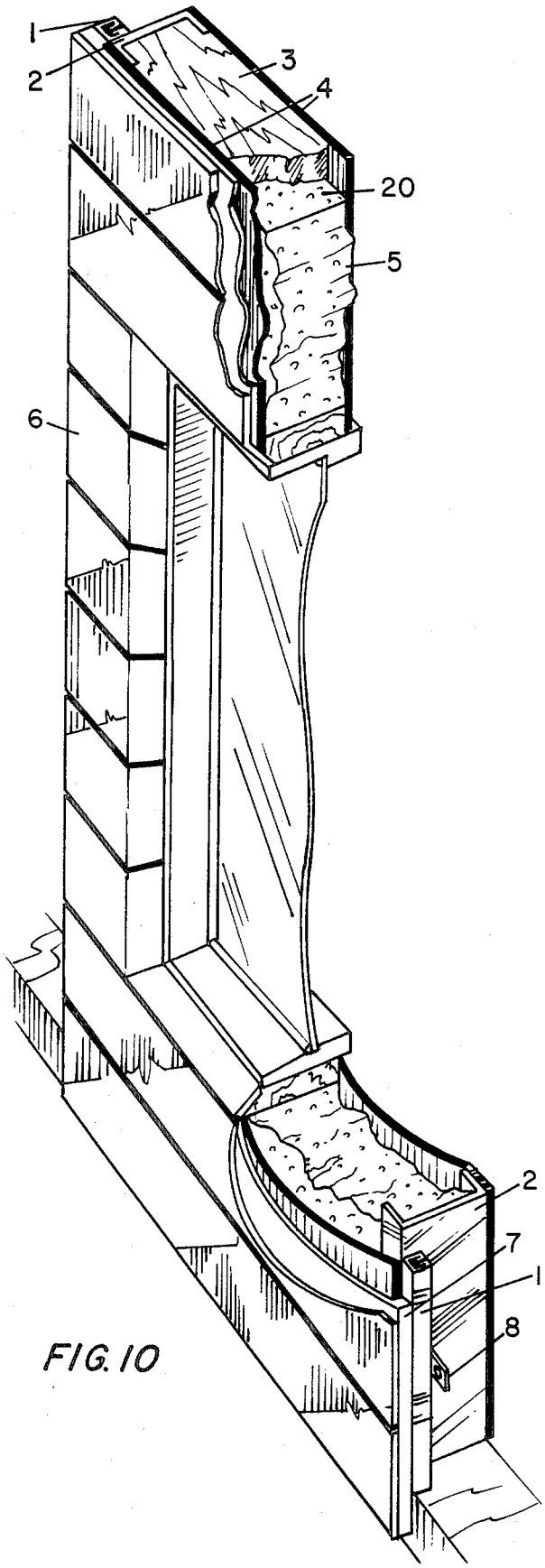
FIG. 10 is a perspective view of a respective panel section with a window made therein.

In FIG. 9 a filler 31 such as caulking or grout is shown in the exterior recess 34 formed between two attached panels 30, and insulation 32 is shown in the interior recess 35 so formed. Further, the interior wall 14 is shown attached to the interior sheeting 4.

What is claimed is:

1. A panel for use in building construction comprising in combination:

a core of ridged heat insulation, generally rectangular in shape with opposed major surfaces, opposed longitudinal edges and opposed ends;

a first and a second U-shaped chanel, each having a first and a second leg, attached over said opposed longitudinal edges whereby the first said leg engages one of said opposed major surfaces and the second said leg engages the other of said opposed major surfaces;

a first and second sheeting, the said first sheeting attached to one of said opposed major surfaces and said legs engaging the same and the said second sheeting attached to the other of said opposed major surfaces and said legs engaging the same;

a first and second flange permanently attached respectively to said first and second channel, each said flange having attaching means whereby the same may be attached to the opposite flange of another panel; facade adhesively bonded to the exposed surface said first sheeting throughout their contacting surfaces and extending beyond the said first sheeting longitudinal edges to the far edges of said flanges; and a top and a bottom end cap placed on said opposed ends, between said channel legs and between said sheeting to form convenient attaching surfaces.

2. The panel according to claim 1 wherein said first and second sheeting is wafer board, plywood, or Structurwood®.

3. The panel according to claim 2 wherein said first and second second flange are C-shaped channels and wherein said attacking means are a series of metal plates with receptacles in either end thereof to receive a bolt, which said bolt attaches to a nut wedgedly located inside said C-shaped channel.

4. The panel according to claim 3 wherein the facade are bonded with polymer concrete.

5. A system of interlocking panels comprising in combination:

a plurality of panels according to claim 4, wherein the said first flange of one panel is attached to the said second flange of another causing the said panels to be a uniform predetermined distance apart and forming a cavity between the longitudinal sides of the said panels;

a filler inserted in that portion of said cavity juxtapositioned nearest said facade;

an insulating material inserted in that portion of said cavity juxtapositioned nearest said channels; and a finished wall covering attached to the exposed surface of said second sheeting.

* * * * *